US009115422B2

(12) United States Patent
Steiger et al.

(10) Patent No.: US 9,115,422 B2
(45) Date of Patent: Aug. 25, 2015

(54) COMPOSITIONS CONTAINING INDIUM ALKOXIDE, METHOD FOR THE PRODUCTION THEREOF, AND USE THEREOF

(75) Inventors: Juergen Steiger, Duesseldorf (DE); Heiko Thiem, Bensheim (DE); Alexey Merkulov, Ludwigshafen (DE); Duy Vu Pham, Oberhausen (DE); Yvonne Damaschek, Recklinghausen (DE); Arne Hoppe, Herne (DE)

(73) Assignee: Evonik Degussa GmbH, Essen (DE)

( * ) Notice: Subject to any disclaimer, the term of this patent is extended or adjusted under 35 U.S.C. 154(b) by 257 days.

(21) Appl. No.: 13/148,967

(22) PCT Filed: Feb. 5, 2010

(86) PCT No.: PCT/EP2010/051409

§ 371 (c)(1),
(2), (4) Date: Aug. 11, 2011

(87) PCT Pub. No.: WO2010/094581

PCT Pub. Date: Aug. 26, 2010

(65) Prior Publication Data

US 2011/0309313 A1 Dec. 22, 2011

(30) Foreign Application Priority Data

Feb. 17, 2009 (DE) ..... 10 2009 009 338

(51) Int. Cl.
*H01B 1/02* (2006.01)
*C23C 18/12* (2006.01)

(52) U.S. Cl.
CPC ..... *C23C 18/1216* (2013.01); *C23C 18/125* (2013.01)

(58) Field of Classification Search
CPC ..... C07C 31/28; C07C 29/70; C07D 487/00
USPC ..... 252/519.21; 556/105; 438/48
See application file for complete search history.

(56) References Cited

U.S. PATENT DOCUMENTS

| | | | | |
|---|---|---|---|---|
| 2002/0087018 | A1* | 7/2002 | Celinska et al. | 556/105 |
| 2010/0132788 | A1 | 6/2010 | Petrat et al. | |
| 2011/0193084 | A1 | 8/2011 | Thiem et al. | |
| 2012/0213980 | A1 | 8/2012 | Arning et al. | |
| 2013/0221352 | A1 | 8/2013 | Steiger et al. | |

FOREIGN PATENT DOCUMENTS

| | | | |
|---|---|---|---|
| JP | 2007 042689 | | 2/2007 |
| JP | 2007-042689 | * | 2/2007 |
| WO | 2009 081968 | | 7/2009 |
| WO | 2010 094583 | | 8/2010 |

OTHER PUBLICATIONS

U.S. Appl. No. 13/516,900, filed Jun. 18, 2012, Steiger, et al.
U.S. Appl. No. 13/515,007, filed Jun. 11, 2012, Steiger, et al.
International Search Report issued Jul. 26, 2010 in PCT/EP10/051409 filed Feb. 5, 2010.
U.S. Appl. No. 13/201,107, filed Aug. 29, 2011, Hoppe, et al.
U.S. Appl. No. 13/391,114, filed Feb. 17, 2012, Steiger, et al.
U.S. Appl. No. 13/390,840, filed Feb. 16, 2012, Steiger, et al.
U.S. Appl. No. 13/809,322, filed Jan. 9, 2013, Steiger, et al.
U.S. Appl. No. 13/809,423, filed Jan. 10, 2013, Steiger, et al.
U.S. Appl. No. 12/596,150, filed Oct. 16, 2009, Petrat, et al.
U.S. Appl. No. 13/123,072, filed Apr. 7, 2011, Thiem, et al.
U.S. Appl. No. 13/503,789, filed Apr. 24, 2012, Arning, et al.
U.S. Appl. No. 13/884,495, filed May 9, 2013, Steiger, et al.

* cited by examiner

*Primary Examiner* — Monique Peets
(74) *Attorney, Agent, or Firm* — Oblon, McClelland, Maier & Neustadt, L.L.P.

(57) ABSTRACT

The present invention relates to a liquid indium alkoxide-containing composition comprising at least one indium alkoxide and at least three solvents $L_1$, $L_2$ and $L_3$, in which the solvent $L_1$ is selected from the group consisting of ethyl lactate, anisole, tetrahydrofurfuryl alcohol, butyl acetate, ethylene glycol diacetate and ethyl benzoate, and the difference between the boiling points of the two solvents $L_2$ and $L_3$ under SATP conditions is at least 30° C., to processes for preparation thereof and to the use thereof.

21 Claims, 2 Drawing Sheets

Figure 1:
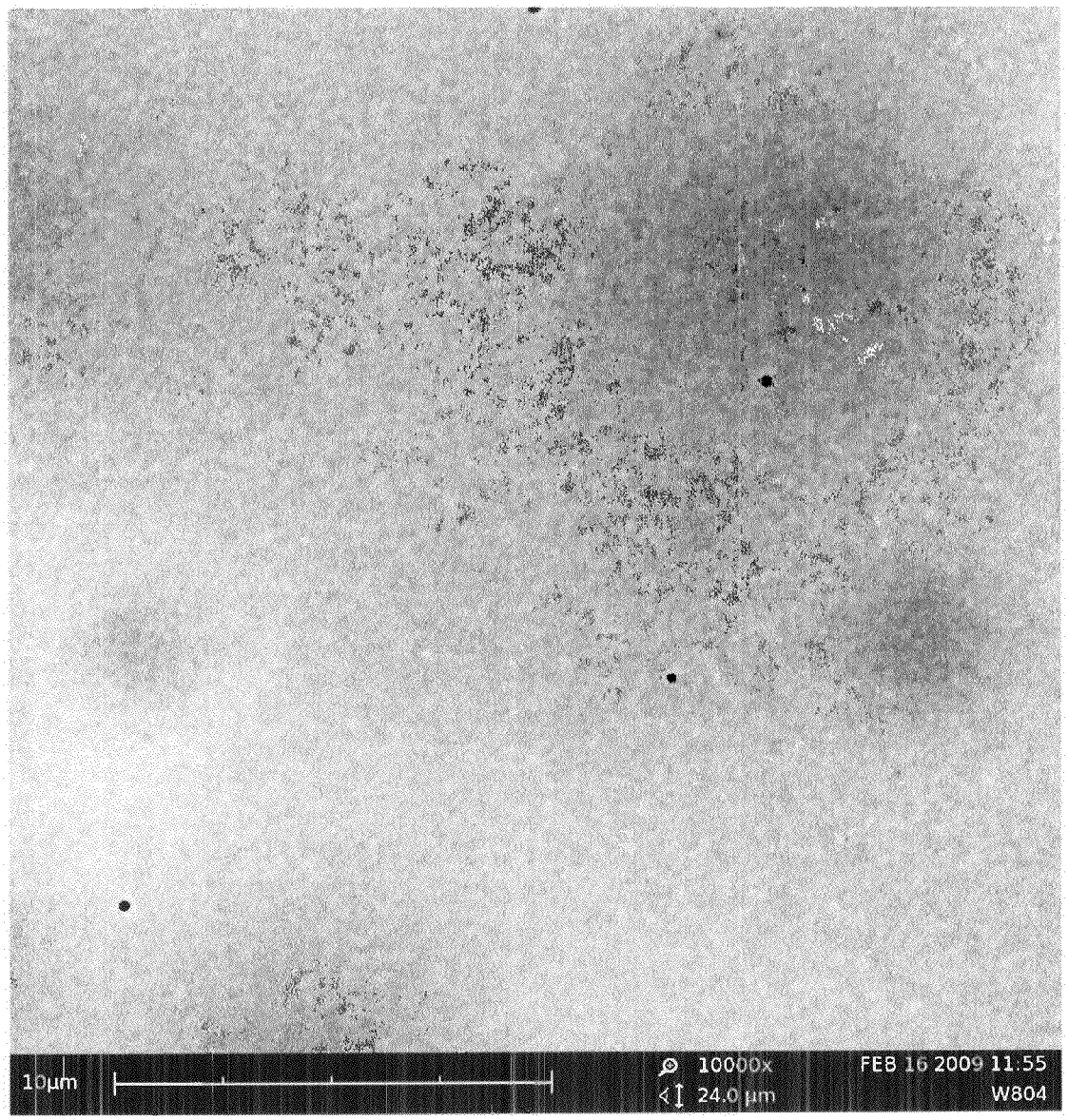

COMPOSITIONS CONTAINING INDIUM ALKOXIDE, METHOD FOR THE PRODUCTION THEREOF, AND USE THEREOF

The present invention relates to indium alkoxide-containing compositions, process for preparation thereof and use thereof.

The preparation of semiconductive electronic component layers by means of printing processes enables much lower production costs compared to many other processes, for example Chemical Vapour Deposition (CVD), since the semiconductor can be deposited here in a continuous printing process. Furthermore, at low process temperatures, there is the possibility of working on flexible substrates, and possibly (in particular in the case of very thin layers and especially in the case of oxidic semiconductors) of achieving optical transparency of the printed layers. Semiconductive layers are understood here and hereinafter to mean layers which have charge mobilities of 0.1 to 50 $cm^2/Vs$ for a component with a channel length of 20 μm and a channel width of 1 cm at gate-source voltage 50 V and source-drain voltage 50 V.

Since the material of the component layer to be produced by means of printing processes crucially determines the particular layer properties, the selection thereof has an important influence on any component containing this component layer. Important parameters for printed semiconductor layers are the particular charge carrier mobilities thereof, and the processibilities and processing temperatures of the printable precursors used in the course of production thereof. The materials should have good charge carrier mobility and be producible from solution and at temperatures significantly below 500° C. in order to be suitable for a multitude of applications and substrates. Likewise desirable for many novel applications is optical transparency of the semiconductive layers obtained.

Owing to the large band gap between 3.6 and 3.75 eV (measured for layers applied by vapour deposition) [H. S. Kim, P. D. Byrne, A. Facchetti, T. J. Marks; *J. Am. Chem. Soc.* 2008, 130, 12580-12581], indium oxide (indium(III) oxide, $In_2O_3$) is a promising semiconductor. Thin films of a few hundred nanometers in thickness may additionally have a high transparency in the visible spectral range of greater than 90% at 550 nm. In extremely highly ordered indium oxide single crystals, it is additionally possible to measure charge carrier mobilities of up to 160 $cm^2/Vs$. To date, however, it has not been possible to achieve such values by processing from solution [H. Nakazawa, Y. Ito, E. Matsumoto, K. Adachi, N. Aoki, Y. Ochiai; *J. Appl. Phys.* 2006, 100, 093706. and A. Gupta, H. Cao, Parekh, K. K. V. Rao, A. R. Raju, U. V. Waghmare; *J. Appl. Phys.* 2007, 101, 09N513].

Indium oxide is often used in particular together with tin (IV) oxide ($SnO_2$) as the semiconductive mixed oxide ITO. Owing to the comparatively high conductivity of ITO layers with simultaneous transparency in the visible spectral region, one use thereof is that in liquid-crystal displays (LCDs), especially as "transparent electrode". These usually doped metal oxide layers are produced industrially in particular by costly vapour deposition methods under high vacuum. Owing to the great economic interest in ITO-coated substrates, there now exist some coating processes, based on sol-gel techniques in particular, for indium oxide-containing layers.

In principle, there are two options for the production of indium oxide semiconductors via printing processes: 1) particle concepts in which (nano)particles are present in printable dispersion and, after the printing operation, are converted to the desired semiconductor layer by sintering operations, and 2) precursor concepts in which at least one soluble precursor, after being printed, is converted to an indium oxide-containing layer. The particle concept has two important disadvantages compared to the use of precursors: firstly, the particle dispersions have colloidal instability which necessitates the use of dispersing additives (which are disadvantageous in respect of the later layer properties); secondly, many of the usable particles (for example owing to passivation layers) only incompletely form layers by sintering, such that some particulate structures still occur in the layers. At the particle boundary thereof, there is considerable particle-particle resistance, which reduces the mobility of the charge carriers and increases the general layer resistance.

There are various precursors for the production of indium oxide-containing layers. For example, in addition to indium salts, it is also possible to use indium alkoxides as precursors for the production of indium oxide-containing layers.

For example, Marks et al. describe components which have been produced using a precursor solution of $InCl_3$ and of the base monoethanolamine (MEA) dissolved in methoxyethanol. After spin-coating of the solution, the corresponding indium oxide layer is obtained by a thermal treatment at 400° C. [H. S. Kim, P. D. Byrne, A. Facchetti, T. J. Marks; *J. Am. Chem. Soc.* 2008, 130, 12580-12581 and supplemental information].

Compared to indium salt solutions, indium alkoxide solutions have the advantage that they can be converted to indium oxide-containing coatings at lower temperatures.

Indium alkoxides and the synthesis thereof have been described since as early as the 1970s. Mehrotra et al. describe the preparation of indium trisalkoxide $In(OR)_3$ from indium (III) chloride ($InCl_3$) with Na—OR where R represents methyl, ethyl, isopropyl, n-, s-, t-butyl and -pentyl radicals [S. Chatterjee, S. R. Bindal, R. C. Mehrotra; *J. Indian Chem. Soc.* 1976, 53, 867].

Bradley et al. report a similar reaction to Mehrotra et al. and obtain, with virtually identical reactants ($InCl_3$, isopropylsodium) and reaction conditions, an indium-oxo cluster with oxygen as the central atom [D. C. Bradley, H. Chudzynska, D. M. Frigo, M. E. Hammond, M. B. Hursthouse, M. A. Mazid; *Polyhedron* 1990, 9, 719].

Hoffman et al. disclose an alternative synthesis route to indium isopropoxide and obtain, in contrast to Mehrotra et al., an insoluble white solid. They suspect a polymeric substance $[In(O\text{-}iPr)_3]_n$ [S. Suh, D. M. Hoffman; *J. Am. Chem. Soc.* 2000, 122, 9396-9404].

Many processes for producing indium oxide-containing coatings via precursor processes are based on sol-gel techniques in which metallate gels producible from precursors are converted by a conversion step to the corresponding oxide layers.

For instance, JP 11-106934 A (Fuji Photo Film Co. Ltd.) describes a process for producing a transparent conductive metal oxide film on a transparent substrate via a sol-gel process, in which a metal alkoxide or a metal salt, preferably an indium alkoxide or indium salt, is hydrolysed in solution below 0° C., and then the hydrolysate is heated.

JP 06-136162 A (Fujimori Kogyo K.K.) describes a process for producing a metal oxide film from solution on a substrate, in which a metal alkoxide solution, especially an indium isopropoxide solution, is converted to a metal oxide gel, applied to a substrate, dried and treated with heat, in which UV radiation is effected before, during or after the drying and heat treatment step.

JP 09-157855 A (Kansai Shin Gijutsu Kenkyusho K.K.) also describes the production of metal oxide films from metal alkoxide solutions via a metal oxide sol intermediate, which are applied to the substrate and converted to the particular metal oxide by UV radiation. The resulting metal oxide may be indium oxide.

CN 1280960 A describes the production of an indium tin oxide layer from solution via a sol-gel process, in which a mixture of metal alkoxides is dissolved in a solvent, hydrolysed and then used to coat a substrate with subsequent drying and curing.

A common feature of these sol-gel processes, however, is that their gels are unsuitable for use in printing processes owing to high viscosity and/or, especially in the case of solutions of low concentration, the resulting indium oxide-containing layers have inhomogeneities and hence poor layer parameters. Inhomogeneity is understood in the present case to mean crystal formation in individual domains which leads to RMS surface roughness of more than 20 nm (RMS roughness=root-mean-square roughness; measured by means of atomic force microscopy). This roughness firstly has an adverse effect on the layer properties of the indium oxide-containing layer (the result is in particular charge carrier mobilities which are too low for semiconductor applications), and secondly has an adverse effect on the application of further layers to obtain a component.

In contrast to the sol-gel techniques described to date, JP 11-106935 A (Fuji Photo Film Co. Ltd.) describes a process for producing a conductive metal oxide film on a transparent substrate, in which curing temperatures below 250° C., preferably below 100° C., are achieved by thermally drying a coating composition containing a metal alkoxide and/or a metal salt on a transparent substrate and then converting it with UV or VIS radiation.

However, the conversion via electromagnetic radiation used in this process has the disadvantage that the resulting semiconductor layer is rippled and uneven on the surface. This results from the difficulty of achieving a homogeneous and uniform distribution of radiation on the substrate.

JP 2007-042689 A describes metal alkoxide solutions which obligatorily contain zinc alkoxides and may further contain indium alkoxides, and processes for producing semiconductor components which use these metal alkoxide solutions. The metal alkoxide films are treated thermally and converted to the oxide layer.

However, these systems too do not provide sufficiently homogeneous films.

It is thus an object of the present invention to provide systems, with respect to the known prior art, with which indium oxide-containing layers can be produced without the disadvantages mentioned of the prior art cited, i.e. to provide systems which are usable in conventional printing processes and with which indium oxide-containing layers of better quality can be produced, which have a high homogeneity and low rippling, unevenness and roughness (especially an RMS roughness of ≤20 nm).

This object is achieved by liquid indium alkoxide-containing compositions comprising at least one indium alkoxide and at least three solvents $L_1$, $L_2$ and $L_3$, characterized in that the solvent $L_1$ is selected from the group consisting of ethyl lactate, anisole, tetrahydrofurfuryl alcohol, butyl acetate, ethylene glycol diacetate and ethyl benzoate, and the difference between the boiling points of the two solvents $L_2$ and $L_3$ under SATP conditions is at least 30° C.

It has been found that, surprisingly, in compositions comprising more than two solvents, without a significant deterioration in the quality of the indium oxide-containing layers obtainable with the composition, the storage stability and the shelf life of the inventive compositions under air improve significantly compared to systems comprising only two solvents. This effect was particularly marked when the system comprised at least one of the following solvents: ethyl lactate, anisole, tetrahydrofurfuryl alcohol or butyl acetate.

Liquid compositions in the context of the present invention are understood to mean those which are in liquid form under SATP conditions ("Standard Ambient Temperature and Pressure"; T=25° C. and p=1013 hPa).

The indium alkoxide is preferably an indium(III) alkoxide. The indium(III) alkoxide is more preferably an alkoxide having at least one C1- to C15-alkoxy or -oxyalkylalkoxy group, more preferably at least one C1- to C10-alkoxy or -oxyalkylalkoxy group. The indium(III) alkoxide is most preferably an alkoxide of the generic formula $In(OR)_3$ in which R is a C1- to C15-alkyl or -alkyloxyalkyl group, even more preferably a C1- to C10-alkyl or -alkyloxyalkyl group. This indium(III) alkoxide is more preferably $In(OCH_3)_3$, $In(OCH_2CH_3)_3$, $In(OCH_2CH_2OCH_3)_3$, $In(OCH(CH_3)_2)_3$ or $In(O(CH_3)_3)_3$. Even more preferably, $In(OCH(CH_3)_2)_3$ (indium isopropoxide) is used.

The indium alkoxide is present in the composition preferably in proportions of 1 to 15% by weight, more preferably 2 to 10% by weight, most preferably 2.5 to 7.5% by weight, based on the total mass of the composition.

The solvents $L_2$ and $L_3$ are preferably each independently organic solvents selected from the group consisting of alcohols, polyalcohols, esters, amines, ketones and aldehydes. It is possible to select essentially any combination of solvents when they are selected such that the difference between the boiling points thereof under SATP conditions is at least 30° C., and it is ensured that at least three different solvents are always present.

Preferred compositions are those in which the boiling point of $L_2$ under SATP conditions is 30-120° C. and the boiling point of $L_3$ under SATP conditions is 120-300° C., again with the proviso that the two solvents selected have a boiling point difference of at least 30° C. under SATP conditions.

The solvent $L_2$ in the composition is even more preferably selected from the group consisting of isopropanol, methanol, ethanol, acetone, toluene, tetrahydrofuran, methyl ethyl ketone, chloroform, ethyl acetate and ethylene glycol dimethyl ether.

Furthermore, $L_3$ is even more preferably selected from the group selected from the group consisting of tetrahydrofurfuryl alcohol, butyl acetate, anisole, ethyl benzoate, ethylene glycol diacetate, ethyl lactate and diethylene glycol, still further preferably diethylene glycol, butyl acetate and ethyl lactate.

Very particularly high-quality indium oxide-containing layers can be obtained with compositions comprising $L_2$=isopropanol and $L_3$=diethylene glycol.

The inventive compositions preferably comprise the solvent $L_2$ in proportions of 30-95% by weight, based on the total mass of the composition, and the solvent $L_3$ in proportions of 0.5-70% by weight, based on the total mass of the composition.

Very particularly storable and stable compositions were achieved with a mixture of the solvents isopropanol, butyl acetate and ethyl lactate.

With the inventive compositions it is possible—in the case that the composition does not contain any further metal precursors aside from the indium alkoxide—to produce very high-quality indium oxide layers. An indium oxide layer in the context of the present invention is understood to mean a metallic layer which is producible from the indium alkoxides mentioned and contains essentially indium atoms or ions, the indium atoms or ions being present essentially in oxidic form.

Optionally, the indium oxide layer may also contain carbene or alkoxide components from an incomplete conversion. In contrast, an indium oxide-containing layer is understood to mean a layer which, in addition to the indium atoms or ions present essentially in oxidic form, also contains further metals, semimetals or corresponding oxides thereof.

The inventive composition advantageously contains, however, at least one further (semi)metal precursor. Particularly high-quality indium oxide-containing layers can be produced when the composition also contains at least one further (semi) metal alkoxide. The term "(semi)metal alkoxide" includes both semimetal alkoxides and metal alkoxides.

This at least one (semi)metal alkoxide is present preferably in proportions of 0.01-7.5% by weight, based on the total mass of the composition.

The at least one (semi)metal alkoxide is preferably an alkoxide of a metal or semimetal selected from the group consisting of the metals or semimetals of group 1, 2, 3, 4, 5, 6, 7, 8, 9, 10, 11, 12, 13, 14 or 15, preferably an alkoxide of a metal or semimetal selected from the group consisting of Zn, Ga, Sn, Mg, Fe, Al, Ba, Cu, Ti, Si, Pb, Zr, Hf, Ta, Nb, Ge, Mn, Re, Ru and Ag. The (semi)metal alkoxide is most preferably an alkoxide of a metal or semimetal selected from the group consisting of Zn, Ga, Sn, Ti and Cu.

The at least one further (semi)metal alkoxide is preferably an alkoxide with at least one C1- to C15-alkoxy or -oxyalkylalkoxy group, more preferably at least one C1- to C10-alkoxy or -oxyalkylalkoxy group. The (semi)metal alkoxide is most preferably an alkoxide of the generic formula $In(OR)_3$ in which R is a C1- to C15-alkyl or -alkyloxyalkyl group, even further preferably a C1- to C10-alkyl or -alkyloxyalkyl group. This (semi)metal alkoxide is more preferably an alkoxide of the $M^{(x)}(OCH_3)_x$, $M(x)(OCH_2CH_3)_x$, $M^{(x)}(OCH_2CH_2OCH_3)_x$, $M^{(x)}(OCH(CH_3)_2)_x$ or $M^{(x)}(O(CH_3)_3)_x$ type, where the index x corresponds to the corresponding valence of the (semi)metal.

The inventive compositions can be prepared by mixing the at least one indium alkoxide with a mixture comprising the at least three solvents.

Alternatively, the inventive compositions can also be prepared by mixing a composition comprising the at least one indium alkoxide and at least one solvent with the other solvent(s).

The present invention further provides for the use of the inventive compositions for producing semiconductive structures.

The semiconductive indium oxide-containing structures producible with the inventive compositions have charge carrier mobilities in the range from 0.1 to 50 $cm^2/Vs$ (measured at gate-source voltage 50 V, drain-source voltage 50 V, channel width 1 cm and channel length 20 μm), which can be determined via the model of "gradual channel approximation". To this end, the formulae known from conventional MOSFETs are used. In the linear range, the following equation applies:

$$I_D = \frac{W}{L} C_i \mu \left(U_{GS} - U_T - \frac{U_{DS}}{2}\right) U_{DS} \tag{1}$$

where $I_D$ is the drain current, $U_{DS}$ is the drain-source voltage, $U_{GS}$ is the gate-source voltage, $C_i$ is the area-normalized capacitance of the insulator, W is the width of the transistor channel, L is the channel length of the transistor, μ is the charge carrier mobility and $U_T$ is the threshold voltage.

In the saturation range, there is a quadratic dependence between drain current and gate voltage, which is used in the present case to determine the charge carrier mobility:

$$I_D = \frac{W}{2L} C_i \mu (U_{GS} - U_T)^2 \tag{2}$$

The inventive compositions are preferably used in processes for producing semiconductive indium oxide-containing structures, especially semiconductive indium oxide-containing layers. The invention therefore also provides for the use of the inventive compositions for producing semiconductive structures. This use is preferably in the form of use of the inventive compositions in coating processes with which semiconductive structures are produced. The inventive compositions are particularly suitable for use in coating processes selected from printing processes (especially flexographic/gravure printing, inkjet printing, offset printing, digital offset printing and screen printing), spraying processes, spin-coating processes and dip-coating processes. The coating process according to the invention is most preferably a printing process.

The substrate which is used in these processes according to the invention is preferably a substrate selected from substrates consisting of glass, silicon, silicon dioxide, a metal oxide or transition metal oxide, or a polymeric material, especially PE, PEN, PI or PET.

After the coating and before the conversion, the coated substrate can additionally be dried. Corresponding measures and conditions for this purpose are known to those skilled in the art.

The conversion of the structure or layer obtained to indium oxide or an indium oxide-containing layer or structure can be effected by a thermal route and/or by UV, IR or VIS radiation. Particularly good results can be achieved, however, when temperatures of 150° C. to 360° C. are used for the conversion.

Typically, conversion times of a few seconds up to several hours are used.

The conversion can additionally be promoted by contacting the layer obtained after the coating step, before the thermal treatment, with water and/or hydrogen peroxide, and first converting it to a metal hydroxide in an intermediate step before the thermal conversion.

The quality of the layer obtained by the process according to the invention can additionally be further improved by a combined thermal and gas treatment (with $H_2$ or $O_2$), plasma treatment (Ar, $N_2$, $O_2$ or $H_2$ plasma), microwave treatment, laser treatment (with wavelengths in the UV, VIS or IR range), UV light, infrared radiation or an ozone treatment, which follows the conversion step.

The invention further provides indium oxide-containing layers producible with the inventive compositions.

The indium oxide-containing structures producible with the inventive compositions are also advantageously suitable for the production of electronic components, especially the production of (thin-film) transistors, diodes or solar cells.

The examples which follow are intended to illustrate the subject-matter of the present invention in detail.

COMPARATIVE EXAMPLE

Preparation of Solution 0

10% by volume of isopropanol was added to a 5% by weight solution of indium(III) isopropoxide in isopropanol (b.p.: 82° C.). In this way, effects arising from the altered concentration in the inventive example can be ruled out.

Coating

A doped silicon substrate with an edge length of about 15 mm and with a silicon oxide coating of thickness approx. 200 nm and finger structures composed of ITO/gold was coated under the same conditions as detailed above with 100 μl of the solution 0 prepared by spin-coating (2000 rpm) under air under SATP conditions. After the coating operation, the coated substrate was heat treated under air at a temperature of 350° C. for one hour.

Figure 2:
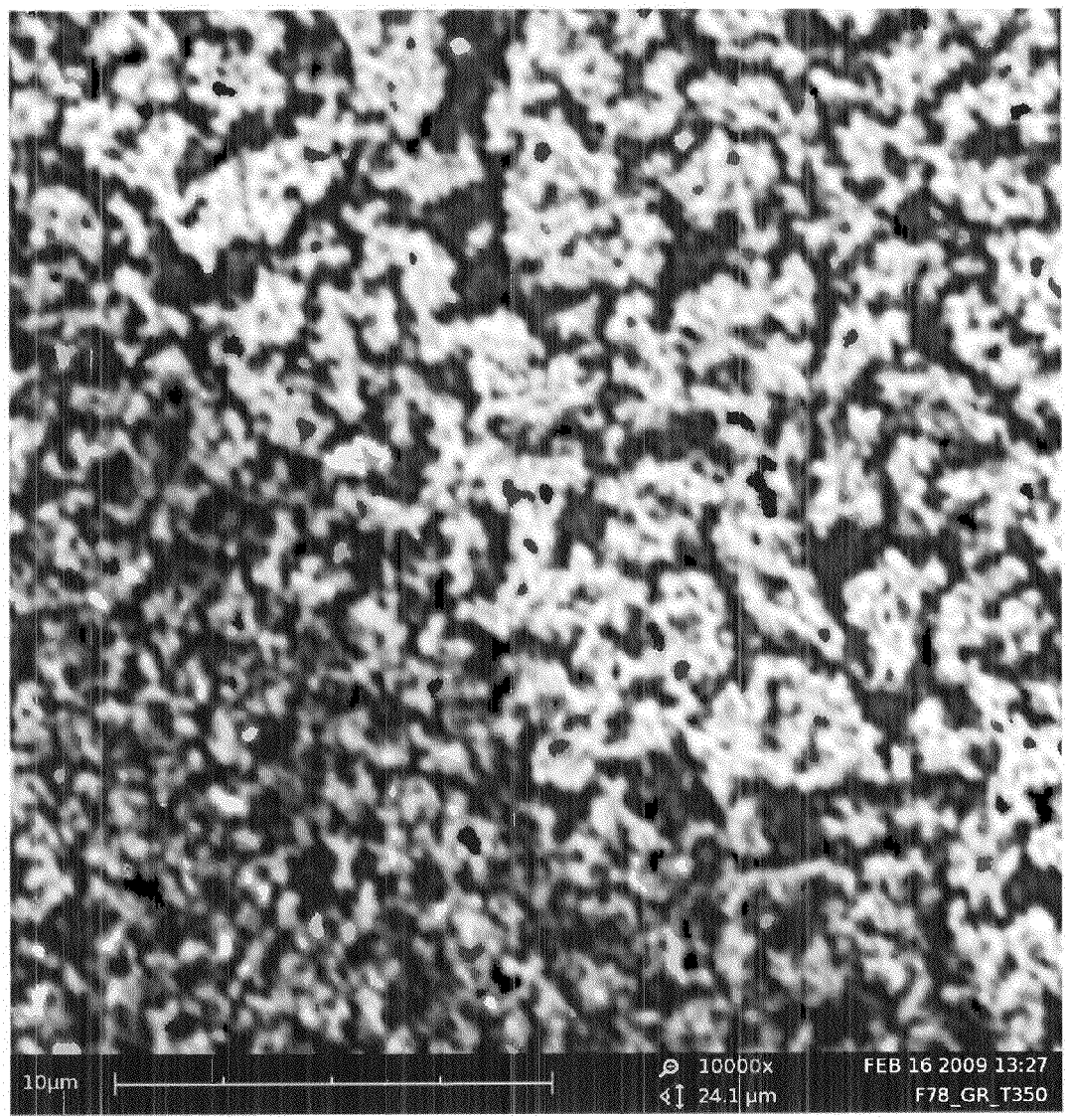

FIG. 1 shows an SEM image of the resulting $In_2O_3$ layer of the inventive coating, FIG. 2 a corresponding SEM image of the comparative example (magnification: 10 000×). Clearly discernible is the significantly lower roughness of the inventive layer. In addition, the layers of the comparative example are significantly less homogeneous than those of the inventive example.

The inventive coating exhibits a charge carrier mobility of 1 $cm^2/Vs$ (at gate-source voltage 50 V, source-drain voltage 50 V, channel width 1 cm and channel length 20 μm). In contrast, the charge carrier mobility in the layer of the comparative example is only 0.02 $cm^2/Vs$ (at gate-source voltage 50 V, source-drain voltage 50 V, channel width 1 cm and channel length 20 μm).

Inventive Examples 1-4

Analogously to the above example, further compositions were produced. These solutions were used analogously to the comparative example to build transistors, and the charge carrier mobilities thereof were measured. Table 1 contains the composition of the solutions prepared and the mobility is measured.

Preparation of Solution 1

10% by volume of a mixture of 50% by volume of butyl acetate (b.p.: 127° C.) and 50% by volume of ethyl lactate (b.p.: 154° C.) was added to a 5% by weight solution of indium(III) isopropoxide in isopropanol (b.p.: 82° C.).

Preparation of Solution 2

10% by volume of a mixture of 50% by volume of diethylene glycol (b.p.: 244° C.) and 50% by volume of anisole (b.p.: 155° C.) was added to a 5% by weight solution of indium(III) isopropoxide in isopropanol (b.p.: 82° C.).

Preparation of Solution 3

10% by volume of a mixture of 50% by volume of diethylene glycol (b.p.: 244° C.) and 50% by volume of ethylene glycol diacetate (b.p.: 190° C.) was added to a 5% by weight solution of indium(III) isopropoxide in isopropanol (b.p.: 82° C.).

Preparation of Solution 4

10% by volume of a mixture of 50% by volume of diethylene glycol (b.p.: 244° C.) and 50% by volume of ethyl benzoate (b.p.: 214° C.) was added to a 5% by weight solution of indium(III) isopropoxide in isopropanol (b.p.: 82° C.).

Coating

A doped silicon substrate with an edge length of about 15 mm and with a silicon oxide coating of thickness approx. 200 nm and finger structures of ITO/gold was coated under the same conditions as stated above with 100 μl of the particular solution by spin-coating (2000 rpm) under air under SATP conditions. After the coating operation, the coated substrate was heat treated under air at a temperature of 350° C. for one hour. The results of the electrical measurements can be taken from Table 1.

TABLE 1

| Example No. | Solvent 1 | bp sol. 1 | Solvent 2 | bp sol. 2 | Solvent 3 | bp sol. 3 | μ |
|---|---|---|---|---|---|---|---|
| 0 | isopropanol | 82° C. | — | — | — | — | 0.02 $cm^2/Vs$ |
| 1 | isopropanol | 82° C. | butyl acetate | 127° C. | ethyl lactate | 154° C. | 0.4 $cm^2/Vs$ |
| 2 | isopropanol | 82° C. | diethylene glycol | 244° C. | anisole | 155° C. | 0.6 $cm^2/Vs$ |
| 3 | isopropanol | 82° C. | diethylene glycol | 244° C. | ethylene glycol diacetate | 190° C. | 0.8 $cm^2/Vs$ |
| 4 | isopropanol | 82° C. | diethylene glycol | 244° C. | ethyl benzoate | 214° C. | 0.9 $cm^2/Vs$ |

The invention claimed is:

1. A liquid indium alkoxide-containing composition, comprising:

a) at least one indium alkoxide; and b) at least three solvents $L_1$, $L_2$ and $L_3$;

wherein the solvent $L_1$ is selected from the group consisting of ethyl lactate, anisole, tetrahydrofurfuryl alcohol, butyl acetate, ethylene glycol diacetate and ethyl benzoate, and the difference between the boiling points of the two solvents $L_2$ and $L_3$ under SATP conditions is at least 30° C., and wherein the proportion of $L_2$ is 30-95% by weight, based on total mass of the composition, and the proportion of $L_3$ is 0.5-70% by weight, based on total mass of the composition.

2. The composition according to claim 1, wherein the solvent $L_1$ is selected from the group consisting of ethyl lactate, anisole, tetrahydrofurfuryl alcohol and butyl acetate.

3. The composition according to claim 1, wherein the at least one indium alkoxide is an indium(III) alkoxide having at least one C1- to C15-alkoxy or oxyalkylalkoxy group.

4. The composition according to claim 3, wherein the indium(III) alkoxide is indium isopropoxide.

5. The composition according to claim 1, wherein the at least one indium alkoxide is present in the composition in proportions of 1 to 15% by weight, based on total mass of the composition.

6. The composition according to claim 1, wherein the solvents $L_2$ and $L_3$ are organic solvents, which are each independently selected from the group consisting of alcohols, polyalcohols, esters, amines, ketones and aldehydes.

7. The composition according to claim 1, wherein the boiling point of $L_2$ under SATP conditions is 30-120° C. and the boiling point of $L_3$ under SATP conditions is 120-300° C.

8. The composition according to claim 1, wherein $L_2$ is selected from the group consisting of isopropanol, methanol, ethanol, acetone, toluene, tetrahydrofuran, ethyl acetate, methyl ethyl ketone, chloroform and ethylene glycol dimethyl ether.

9. The composition according to claim 1, wherein $L_3$ is selected from the group consisting of tetrahydrofurfuryl alcohol, butyl acetate, diethylene glycol, anisole, ethylene glycol diacetate, ethyl benzoate and ethyl lactate.

10. The composition according to claim 1, wherein said at least three solvents $L_1$, $L_2$ and $L_3$ of said composition comprise the two solvents isopropanol and diethylene glycol.

11. The composition according to claim 1, wherein said at least three solvents $L_1$, $L_2$ and $L_3$ of said composition comprise at least the three solvents isopropanol, butyl acetate and ethyl lactate.

12. The composition according to claim 1, wherein the composition further comprises at least one further metal alkoxide.

13. The composition according to claim 12, wherein the proportion of the at least one further metal alkoxide is 0.01-7.5% by weight, based on total mass of the composition.

14. A process for preparing the liquid indium alkoxide-containing composition according to claim 1, comprising mixing the at least one indium alkoxide with a mixture of the at least three solvents $L_1$, $L_2$ and $L_3$.

15. A process for preparing the liquid indium alkoxide-containing composition according to claim 1, comprising mixing a composition comprising the at least one indium alkoxide and at least one solvent of the at least three solvents $L_1$, $L_2$ and $L_3$ with at least one other solvent.

16. A semiconductive structure produced from the liquid indium alkoxide-containing composition according to claim 1.

17. An electronic component produced from the liquid indium alkoxide-containing composition according to claim 1.

18. The composition according to claim 1, wherein the at least one indium alkoxide is present in the composition in proportions of 2 to 10% by weight, based on total mass of the composition.

19. The electronic component of claim 17, wherein the electronic component is selected from the group consisting of transistors, diodes, solar cells, thin-film transistors, thin-film diodes and thin-film solar cells.

20. A method of preparing a semiconductive indium oxide-containing structure comprising:

a) coating a substrate with the liquid indium alkoxide-containing composition according to claim 1 to form a coated substrate;

b) drying said coated substrate; and c) converting a coating of said coated substrate into indium oxide or an indium oxide-containing layer by heating or irradiating.

21. The method according to claim 20, wherein said indium oxide or indium oxide containing layer has an RMS roughness of ≤20 nm.

* * * * *